US009498090B2

(12) United States Patent
Barclay

(10) Patent No.: US 9,498,090 B2
(45) Date of Patent: Nov. 22, 2016

(54) LIQUID DISPENSING SYSTEM

(71) Applicant: Keith A. Barclay, Middlesex, NJ (US)

(72) Inventor: Keith A. Barclay, Middlesex, NJ (US)

( * ) Notice: Subject to any disclaimer, the term of this patent is extended or adjusted under 35 U.S.C. 154(b) by 187 days.

(21) Appl. No.: 14/183,881

(22) Filed: Feb. 19, 2014

(65) Prior Publication Data

US 2014/0231458 A1 Aug. 21, 2014

Related U.S. Application Data

(60) Provisional application No. 61/767,124, filed on Feb. 20, 2013.

(51) Int. Cl.
*B67D 7/84* (2010.01)
*A47K 5/12* (2006.01)

(52) U.S. Cl.
CPC ..... *A47K 5/12* (2013.01); *A47K 2005/1218* (2013.01)

(58) Field of Classification Search
CPC ..... A47K 5/12; A47K 2005/1218; B65D 2583/005; B65D 1/0004; B65D 7/02; A47F 1/00
USPC ..... 222/164, 165, 135, 144, 320–321.9, 222/372, 157, 158, 173, 321.1; 4/628; 347/86; 141/2, 22, 18, 247, 272, 141/318–321
See application file for complete search history.

(56) References Cited

U.S. PATENT DOCUMENTS 573,453 A * 12/1896 Duffield ..... A47L 15/427 222/165
577,881 A * 3/1897 Puffer ..... A47B 88/06 222/165
578,098 A * 3/1897 Green ..... A47K 5/10 222/165
603,856 A * 5/1898 Mower ..... A47K 5/10 222/165
626,085 A * 5/1899 Ormerod ..... A47K 5/10 222/165
719,334 A * 1/1903 Herron ..... A47B 49/002 222/165
780,938 A * 1/1905 Clarke ..... A47K 5/10 222/165
878,379 A * 2/1908 Green ..... A47B 88/06 222/165
1,032,861 A * 7/1912 Powell ..... F25D 3/08 222/130
1,206,513 A * 11/1916 Coppes ..... A47K 5/10 222/165
5,244,020 A * 9/1993 Bruno ..... G01G 19/56 141/255
5,277,332 A * 1/1994 Rogers ..... A47K 5/12 221/96
6,568,569 B1 * 5/2003 Betz ..... B05B 9/0426 141/382
7,647,653 B1 * 1/2010 Catania ..... A47K 5/1202 4/628
2003/0048338 A1 * 3/2003 Qingguo ..... B41J 2/17506 347/86
2004/0211000 A1 * 10/2004 Buonocore ..... A47K 5/12 4/675
2005/0121458 A1 6/2005 Rosiello
2007/0246486 A1 * 10/2007 Calandrino ..... A47K 5/12 222/321.1
2011/0121031 A1 * 5/2011 Hardman ..... A47F 1/03 222/129
2011/0259920 A1 * 10/2011 Rennie ..... A47K 5/1205 222/165

* cited by examiner

*Primary Examiner* — J. Cassimer Jacyna
*Assistant Examiner* — Benjamin R Shaw

(57) ABSTRACT

A liquid-dispensing system is disclosed. The system includes a container associated with a base, the container and base being mounted within an enclosure (e.g., a cabinet) or on a ground surface, the container having an inlet and an outlet and being movable relative to the base from a first position to a second, different position to present the inlet for refilling of the container with a liquid. The container is also fluidly connected with a dispenser through its outlet so that liquid can be dispensed to a user. Methods of refilling the container are also disclosed.

16 Claims, 4 Drawing Sheets

LIQUID DISPENSING SYSTEM

CROSS-REFERENCE TO RELATED APPLICATIONS

The present application claims the benefit of the filing date of U.S. Provisional Application No. 61/767,124, filed Feb. 20, 2013 and titled "Slide-Out Liquid Dispensing Container," the disclosure of which is hereby incorporated by reference herein.

BACKGROUND OF THE INVENTION

The present invention relates to a system for storing and dispensing liquid, and methods for replenishing the liquid supply of the system.

Current methods for refilling a sink or counter-mounted dispenser include, in some cases, the following steps: (1) removing the dispenser pump from the counter, (2) reaching over the counter to aim the liquid (e.g., from a refill bottle) into a small opening leading into a container associated with the pump, and (3) inserting the pump back into the opening after filling the container with liquid. It is difficult and cumbersome, however, to reach over the counter, and it is also hard to properly see into the container during filling. This results in spillage, overfilling, and general waste of liquid, not to mention fatigue due to holding the refill container at an awkward angle over the counter. Step (3) also often results in liquid overflowing onto the counter. The above-described process is also generally repeated often due to the small storage capacity of the container, which holds the liquid.

There is therefore a need to provide an improved system for storing and dispensing liquid.

BRIEF SUMMARY OF THE INVENTION

A first aspect of the invention includes a liquid-dispensing system. The system comprises a container secured to a base, the container and base being mounted within an enclosure or on a ground surface, the container having an inlet and an outlet and being movable relative to the base from a first position to a second, different position to present the inlet for refilling of the container with a liquid. A dispenser is also fluidly connected with the container through its outlet.

In certain embodiments of this first aspect, the container and base are mounted within a cabinet. The base may be secured to a section of the cabinet and movement of the container relative to the base from the first position to the second position results in movement of the inlet from a first position within the cabinet to a second, exposed position at least partially outside of the cabinet. In other embodiments, multiple containers may be positioned within the cabinet.

A second aspect of the invention includes a liquid-dispensing system comprising an enclosure and a container secured to a base, the container and base being mounted within the enclosure, the container having an inlet and an outlet and being pivotable relative to the base from a first position to a second, different position to present the inlet for refilling of the container with a liquid. A dispenser may also be fluidly connected with the container through its outlet.

In one embodiment of this second aspect, the base is secured to a section of the enclosure and movement of the container relative to the base from the first position to the second position results in movement of the inlet from a first position within the enclosure to a second, exposed position at least partially outside of the enclosure. A hinge mechanism may also be associated with the container, the hinge mechanism being adapted to facilitate pivoting movement of the container relative to the base from the first position to the second position.

A third aspect of the invention includes a method of refilling a container with liquid comprising: (1) providing a container having an inlet and an outlet, wherein the container is fluidly connected with a dispenser through its outlet, the container being positioned within an enclosure, (2) moving the container from a first position in which the inlet is positioned within the enclosure to a second, different position in which the inlet is at least partially exposed outside of the enclosure, (3) pouring a liquid into the container, and (4) moving the container from the second position back to the first position so that the inlet is situated within the enclosure.

Embodiments of this third aspect also comprise the step of contacting a first surface with a second surface to prevent the container from moving beyond the second position. In addition, the container may be pivoted from the first position to the second position so that the inlet is moved from a first position within the enclosure to a second, exposed position at least partially outside of the enclosure. In another embodiment, the enclosure is a cabinet and the container is secured to a base mounted to a section of the cabinet, the container being selectively removable from the base.

BRIEF DESCRIPTION OF THE DRAWINGS

A more complete appreciation of the subject matter of the present invention and of the various advantages thereof can be realized by reference to the following detailed description in which reference is made to the accompanying drawings in which.

DETAILED DESCRIPTION

In describing particular embodiments of the present invention, specific terminology will be used for the sake of clarity. However, the invention is not intended to be limited to any specific terms used herein, and it is to be understood that each specific term includes all technical equivalents, which operate in a similar manner to accomplish a similar purpose.

Figure 1:
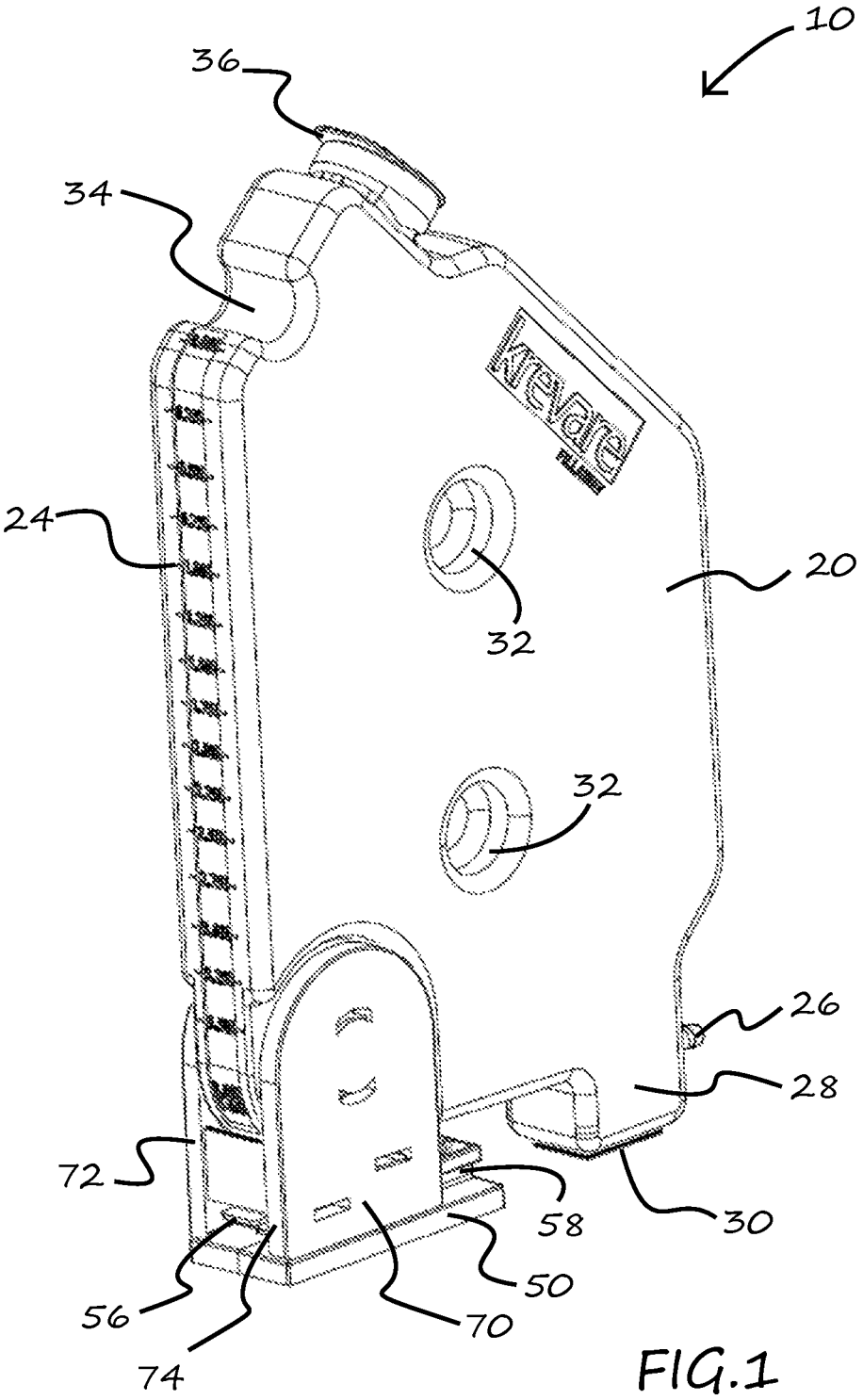
FIG. 1 is a perspective view of a liquid dispensing system in accordance with an embodiment of the invention.
Figure 3:
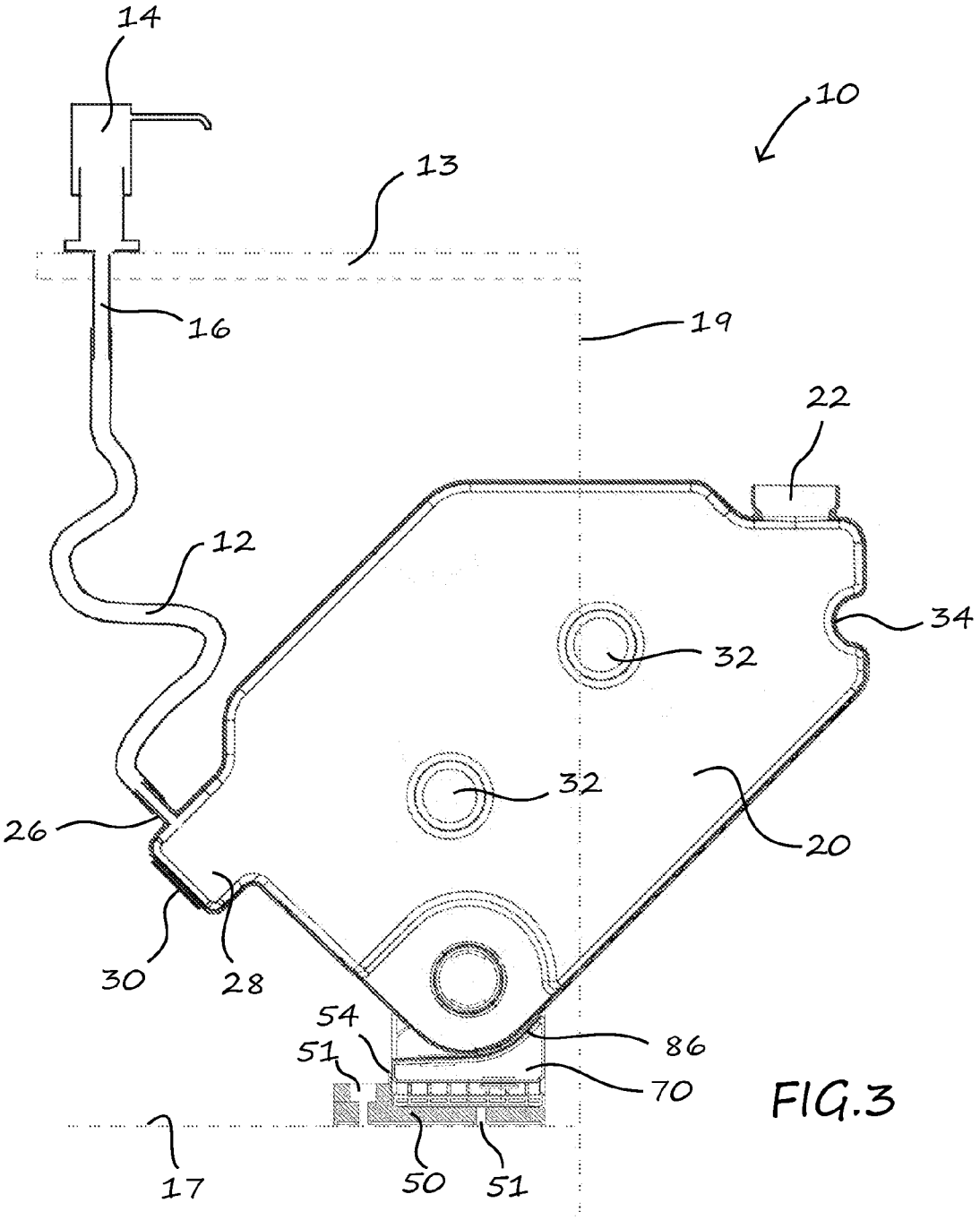
FIG. 3 is a cross-sectional side view of the system of FIGS. 1-2 as installed in a cabinet, the cabinet being shown in dotted lines.

A liquid dispensing system 10 is shown in perspective in FIG. 1, and in a cross-sectional side view in FIG. 3. Liquid dispensing system 10 generally comprises a container 20 mounted within a cabinet or other enclosure 13 (or on the ground), and a tube 12 engaged with container 20. Tube 12 extends to a dispenser 14 for dispensing liquid contained within container 20. In one embodiment, container 20 is hingedly mounted within enclosure 13 by way of a hinge mechanism or housing 70 as shown, for example, in FIG. 3. Thus, container 20 can be rotated out of enclosure 13 for refilling and maintenance. In this manner, liquid dispensing system 10 is easy for a user to use to dispense liquid material, such as hand soap, dishwashing soap, lotion, hand sanitizer, mouth wash, or any other liquid. Liquid dispensing system 10 also allows for effortless refilling when needed.

Figure 2:
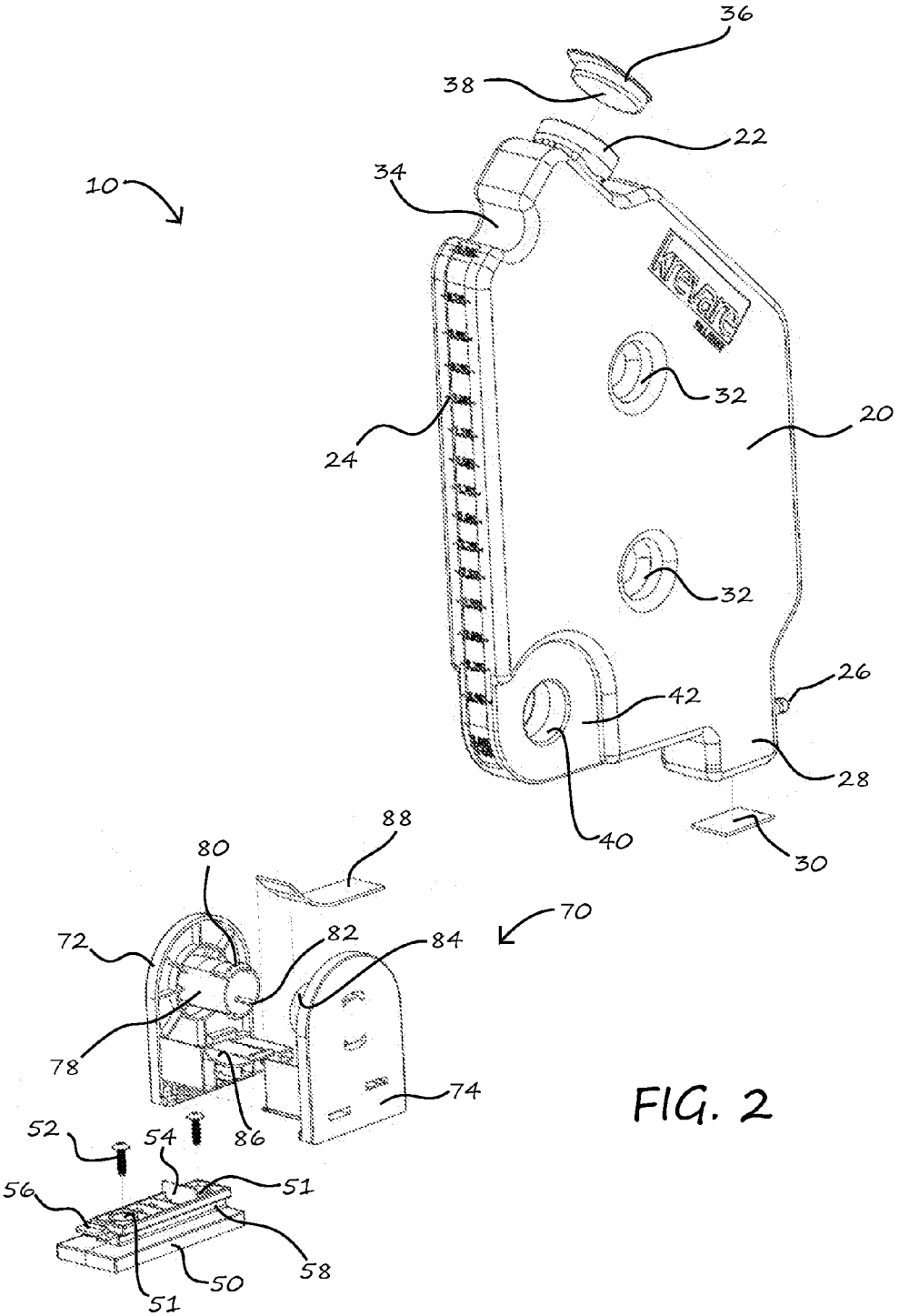
FIG. 2 is an exploded view of the system of FIG. 1.

Referring to FIG. 2, container 20 includes an opening 22 covered by a cap 36 that allows for easy refilling of container 20 with liquid. Cap 36 may include a vent hole 38 to allow air to enter container 20 while its contents are being pumped out. Container 20 also includes an outlet 26, which may or may not have barbs or other like friction-fitting structures on it, through which the liquid inside of container 20 may exit. Outlet 26 sits adjacent a foot 28 that supports container 20 during use. Foot 28 may have a pad 30 attached to it for providing traction and support at that area of container 20.

Container 20 also includes, in a particular embodiment, a finger grip 34 to allow a user to pivot container 20 about a point. This pivoting action is facilitated by a hinge mechanism 70 (described in more detail below), which may be engaged to container 20 through an opening 40 formed through container 20. Opening 40 sits adjacent recesses 42 in container 20 that accept sections of hinge mechanism 70. Container 20 may also include a graduated scale 24 for measuring its contents, and one or more depressions 32 (or "kiss-throughs" as commonly known in the industry) used to prevent bulging of container 20 when filed with liquid material.

As shown in FIG. 2, a baseplate 50 is included with liquid dispensing system 10 for attaching with hinge mechanism 70. Baseplate 50 has a bottom surface that is substantially flat, in one embodiment, for resting on a surface of enclosure 13. Baseplate 50 also includes a set of openings 51 adapted to receive screws or other fixation members 52 to secure baseplate 50 to enclosure 13 or a floor surface. In one embodiment, baseplate 50 also has a stop surface 54 and a snap lever 56 for engaging baseplate 50 to hinge mechanism 70. Grooves 58 may be provided on both sides of baseplate 50 for the same purpose.

Hinge mechanism or housing 70 is also shown in detail in FIG. 2. It includes first and second sides 72, 74, one of which is a female side 74 and the other of which is a male side 72. Male side 72 includes a male protrusion 78 with protuberances 80 and a series of compression slots 82 to define distinct arms of protrusion 78. Protrusion 78 is therefore flexible so that it can be compressed inwards for insertion into a female protrusion 84 formed on female side 74. Female protrusion 84 extending from female side 74 of hinge mechanism 70 provides an opening for receiving male protrusion 78 and a set of recesses or channels (not shown) for interacting with protuberances 80 of male protrusion 78 to interlock sides 72, 74 together.

When sides 72, 74 are joined together, they define a sloped or angled surface 86 at one section. A pad 88 may be positioned on sloped surface 86. As detailed below, sloped surface 86 and pad 88 support and allow container 20 to pivot smoothly about hinge mechanism 70 (as shown, for example, in FIG. 3).

To assemble liquid dispensing system 10, a user may first position baseplate 50 within a cabinet or other enclosure 13, in particular on a floor surface 17 of cabinet 13 with stop surface 54 of baseplate 50 arranged towards the inside of cabinet 13 (FIG. 3). Alternatively, baseplate 50 may be positioned on a ground surface (e.g., in a restroom or other like setting). In the case of positioning baseplate 50 within a cabinet 13, the user may determine the best position for baseplate 50 and then secure it to cabinet 13 by inserting screws 52 through openings 51.

Hinge mechanism 70 and container 20 may then be engaged by connecting together male and female sides 72, 74 of hinge mechanism 70 through opening 40 in container 20 (this may alternatively be completed at the factory). In a particular embodiment, referring to FIG. 2, male protrusion 78 of male side 72 is inserted through opening 40 in container 20 and into female protrusion 84 of female side 74, such that protrusion 78 compresses and protuberances 80 on protrusion 78 engage with the recesses/channels (not shown) of female protrusion 84. As sides 72, 74 of hinge mechanism 70 are being engaged and assembled through opening 40 of container 20, curved sections of sides 72, 74 come to rest in recesses on either side of container 20 (e.g., so that hinge mechanism 70 is snug against container 20 and container 20 may rotate smoothly about hinge mechanism 70). Male protrusion 78 and female protrusion 84, once engaged, cooperate to form a cylindrical post that rests within opening 40 of container 20 to allow container 20 to rotate relative to hinge mechanism 70 about the post. A non-rotated position for container 20 is shown in FIG. 1, while a rotated position for container 20 is depicted in FIG. 3.

Hinge mechanism 70 and container 20, after connection, may then be engaged with baseplate 50 under cabinet 13. In one embodiment, hinge mechanism 70 may include flanges 76 for engaging with grooves 58 on baseplate 50 in a sliding fashion. Stated differently, the user may orient flanges 76, which may be formed on each side 72, 74 of hinge mechanism 70, into alignment with grooves 58 of baseplate 50 and then slide hinge mechanism 70 towards the inside of cabinet 13 to engage mechanism 70 with baseplate 50. The engagement between flanges 76 and grooves 58 is shown best in FIG. 5. Hinge mechanism 70 is slid onto baseplate 50 in the manner described until it abuts stop surface 54 on baseplate 50, as shown in FIG. 3. Snap lever 56 also acts upon a surface of hinge mechanism 70 (e.g., a back wall of sloped surface 86) to secure hinge mechanism 70 and container 20 relative to baseplate 50. In this way, container 20 and hinge mechanism 70 can be engaged with baseplate 50 under cabinet 13 in a removable manner.

With container 20 positioned within cabinet 13, tubing 12 may be connected to outlet 26 of container 20 and likewise to dispenser 14 to establish a fluid connection therebetween. The user may therefore actuate dispenser 14 (e.g., by depressing a pump associated with dispenser 14) to cause liquid to flow from container 20, through its outlet 26, thorough tubing 12, and finally to dispenser 14 for use by the user. Vent opening 38 in cap 36 may allow air to enter into container 20 during pumping of liquid so that it does not become unduly difficult to extract liquid from container 20 (e.g., due to pressure created by a vacuum effect).

An aspect of liquid dispensing system 10 also allows for easy maintenance and refilling of container 20 with liquid. As detailed previously, and shown in FIG. 3, container 20 can be pivoted about hinge mechanism 70 (e.g., via finger grip 34) to move opening 22 of container 20 easily out of cabinet 13. In particular, container 20 may rotate about male and female protrusions 78, 84 of hinge mechanism 70 (cooperatively defining a cylindrical post), once inserted through opening 40. Opening 22 of container 20 can therefore be positioned either inside of cabinet 13 (i.e., in a non-rotated position, as shown in FIG. 1) or outside of cabinet 13 (i.e., in a rotated position with opening 22 beyond front surface 19 of cabinet 13, as shown in FIG. 3). Sloped surface 86 and pad 88 may facilitate rotation of container 20 about hinge mechanism 70, and may also provide a limit for container 20's rotation. For instance, as depicted in FIG. 3, a section of sloped surface 86 is angled by a particular amount so that when a side surface of container 20 rests on the section, no further rotation is permitted. At container 20's point of maximum rotation, as shown in FIG. 3, opening 22 of container 20 is positioned level with floor surface 17 of cabinet 13 and/or the ground. Depending on the size and shape of container 20, this section of sloped surface 86 may be angled by about anywhere between thirty to sixty degrees (30-60°). To refill container 20 with liquid once its liquid level becomes low, the user therefore simply pivots container 20 about its associated hinge mechanism 70 so that opening 22 of container is positioned outside of cabinet 13 and level with floor surface 17 and/or the ground. Prior to pivoting container 20, the user may also determine the amount of liquid needed for the refill by reading scale 24. In one embodiment, scale 24 includes markings that indicate the amount of liquid that can fit into container 20 and also the liquid level of container 20 at any particular moment. Thus, the user can easily determine when a refill is needed, and what amount of liquid can be poured into container 20. The user may then remove cap 36 and pour the necessary amount of liquid into container 20 while it is pivoted out of its resting position.

Once container 20 is refilled as appropriate by the user, the user may then pivot container 20 back within cabinet 13 wherein container 20 may be supported via baseplate 50 and its foot/pad 28/30. Container 20 can then be used once again to dispense liquid through dispenser 14. Liquid dispensing system 10 therefore provides an easy and efficient method for refilling container with liquid.

In one embodiment, during refilling of container 20 with liquid, opening 22 of container 20 may be constructed and arranged so that a refill container can be placed inverted on opening 22 in a hands-free manner for refilling. Stated differently, the user may invert a refill container and place it in opening 22, such that the user does not have to hold the refill container in place while refilling container 20. This provides yet another feature for easy refilling of container 20. In this and other embodiments, container 20 may also be made of transparent material so that the user is able to see the liquid level as liquid enters container 20 during refilling.

If container 20 ever needs to be removed from cabinet 13 (e.g., to replace container 20 after a long cycle of normal wear and tear, to clean container 20, etc.), the user can always depress snap lever 56 on baseplate 50 and slide container 20 out of engagement with baseplate 50. Container 20 can therefore be easily removed from its secure connection with baseplate 50, if needed.

Figure 4:
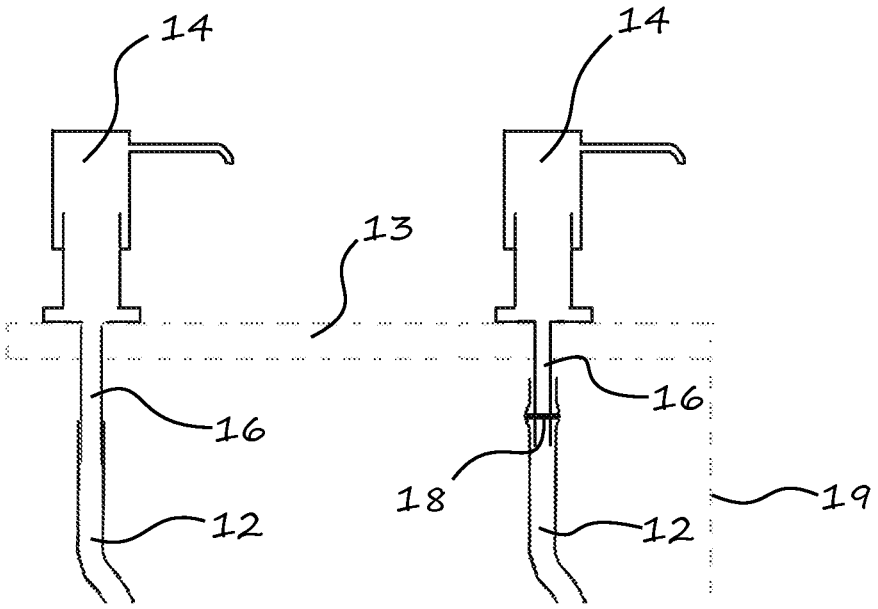
FIG. 4 is side view of tubing connected to a dispenser suction tube.
Figure 5:
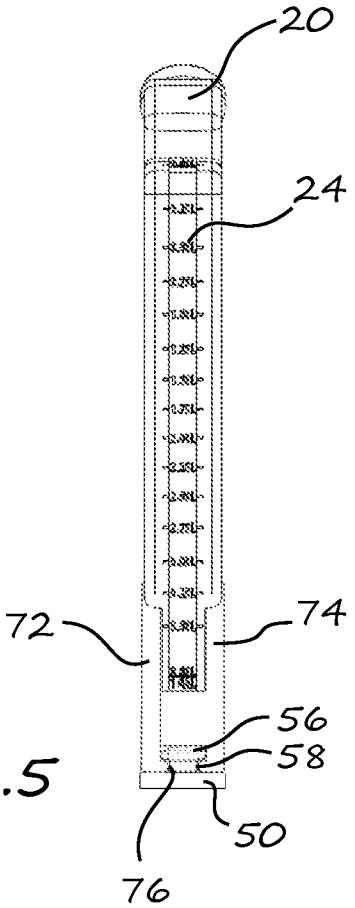
FIG. 5 is a front view of the system of FIGS. 1-3 in a stored position.

In a multiple dispenser 14 scenario, such as that shown in FIG. 4, multiple liquid dispensing systems 10 can be placed side-by-side within cabinet/enclosure 13 so that multiple dispensers 14 can dispense different types of liquid. For example, a first dispenser 14 may dispense liquid hand soap, while a second dispenser 14 may dispense moisturizer. Due to the low-profile construction of liquid dispensing system 10, as shown in FIG. 5, a first baseplate 50 of a first liquid dispensing system 10 may be situated right next to a second baseplate 50 of a second liquid dispensing system 10 so that both systems 10 do not take up a large amount of space within the cabinet/enclosure 13. Indeed, in one embodiment, container 20 is of a slim profile, but has a large capacity, so that multiple containers 20 can be positioned side-by-side within cabinet 13 without the need to refill containers 20 on a frequent basis. And, if a particular container 20 needs to be refilled, it can simply be individually pivoted out of cabinet 13 to present opening 22 for refilling, as shown in FIG. 3 and described above.

FIG. 4 also depicts different connections for connecting tubing 12 to dispensers 14. In one embodiment, tubing 12 may simply be slid over a section of dispenser 14 (e.g., its suction tube 16) to establish a friction fit therewith. In another embodiment, if the size of tubing 12 is too large, a rubber O-ring 18 may be positioned within tubing and slid over dispenser's 14 suction tube 16 so that a leak-tight fit is established therebetween. Once connected to dispenser's 14 suction tube 16, tubing 12 may carry liquid from container 20 and to the user, as described.

Container 20 may be made of any suitable material(s), including for example polypropylene or high-density polyethylene. Hinge mechanism 70 and baseplate 50 may likewise be made of any suitable material(s), including for example nylon or acrylonitrile butadiene styrene. Any of the aforementioned components may be blow molded or injection molded out of a clear or transparent material, if desired.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A liquid-dispensing system comprising:

a container secured to a base that is fixedly mounted within an enclosure or on a ground surface, the container having an inlet for filling the container with a liquid and a separate outlet and the inlet being movable relative to the base from a first position to a second, different position to present the inlet for refilling the container with the liquid;

a sink mounted to a countertop; and a dispenser mounted to the sink or to the countertop, the dispenser being fluidly connected with the container through the container's outlet by way of a conduit, wherein the dispenser has a pump configured to draw the liquid from the container through the container's outlet and dispense the liquid out of the dispenser, and wherein the container and base are mounted within a cabinet, and the base is secured to a section of the cabinet and movement of the container relative to the base from a first position to a second position results in movement of the inlet from its first position, which is within the cabinet, to its second position, which is at least partially outside of the cabinet.

2. A system according to claim 1, wherein the outlet is located at a lower part of the container and the inlet is located at an upper part of the container.

3. A system according to claim 1, further comprising a second container having an inlet and an outlet and being fluidly connected with a second dispenser through the outlet.

4. A system according to claim 1, wherein the container is selectively removable from the base.

5. A system according to claim 1, wherein the container is pivotable relative to the base from its first position to its second position.

6. A system according to claim 5, further comprising a hinge mechanism associated with the container, the hinge mechanism being adapted to facilitate pivoting movement of the container relative to the base from its first position to its second position.

7. A system according to claim 6, wherein the hinge mechanism includes a cylindrical post and the container includes an opening for receiving the post, such that the container is pivotable about the post once inserted through the opening.

8. A system according to claim 6, wherein the hinge mechanism includes a sloped surface arranged to interact with a surface of the container, and wherein interaction between the surfaces prevents the container from pivoting beyond its second position.

9. A liquid dispensing system comprising:

an enclosure;

a container secured to a base, the container and base being mounted within the enclosure, the container having an inlet for filling the container with a liquid and a separate outlet and being pivotable relative to the base from a first position to a second, different position to present the inlet for filling of the container with the liquid;

a sink mounted to a countertop; and a dispenser mounted to the sink or to the countertop, the dispenser being fluidly connected with the container through the container's outlet by way of a conduit, wherein the dispenser has a pump configured to draw the liquid from the container through the container's outlet and dispense the liquid out of the dispenser, and wherein the base is secured to a section of the enclosure and movement of the container relative to the base from the first position to the second position results in movement of the inlet from a first position within the enclosure to a second, exposed position at least partially outside of the enclosure.

10. A system according to claim 9, further comprising a hinge mechanism associated with the container, the hinge mechanism being adapted to facilitate pivoting movement of the container relative to the base from the first position to the second position.

11. A system according to claim 10, wherein the hinge mechanism includes a cylindrical post and the container includes an opening for receiving the post, such that the container is pivotable about the post once inserted through the opening.

12. A system according to claim 9, the system including a sloped surface arranged to interact with a surface of the container, wherein interaction between the surfaces prevents the container from pivoting beyond the second position.

13. A method of filling or refilling a container with liquid comprising:

providing a container having an inlet and a separate outlet, wherein the container is fluidly connected with a dispenser through the container's outlet by way of a conduit, the dispenser having a pump, and wherein the container is positioned within an enclosure, the dispenser is mounted to a sink or a countertop, and the container is secured to a base mounted to a section of the enclosure, the container being selectively removable from the base;

moving the inlet from a first position in which the inlet is positioned within the enclosure to a second, different position in which the inlet is at least partially exposed outside of the enclosure;

pouring a liquid into the container through the container's inlet while the inlet is in the second position;

moving the inlet from the second position back to the first position so that the inlet is situated within the enclosure; and actuating the pump to cause the liquid to flow from the container, through the container's outlet, through the conduit, and out of the dispenser.

14. A method according to claim 13, further comprising the step of contacting a first surface with a second surface to prevent the container from moving beyond the second position.

15. A method according to claim 13, further comprising the step of pivoting the container from a first position to a second position so that the inlet is moved from its first position to its second position.

16. A method according to claim 15, wherein the container is pivoted from its first position to its second position while the container is in fluid connection with the dispenser.

* * * * *